US005205343A

United States Patent [19]

Streubel et al.

[11] Patent Number: 5,205,343

[45] Date of Patent: Apr. 27, 1993

[54] POURING TUBE FOR FEEDING MOLTEN STEEL INTO A CONTINUOUS CASTING MOLD

[75] Inventors: Hans Streubel, Erkrath; Horst Grothe, Kaarst; Jürgen Friedrich, Essen, all of Fed. Rep. of Germany

[73] Assignee: SMS Schloemann-Siemag Aktiengesellschaft, Dusseldorf, Fed. Rep. of Germany

[21] Appl. No.: 706,557

[22] Filed: May 28, 1991

Related U.S. Application Data

[63] Continuation of Ser. No. 529,116, May 25, 1990, abandoned.

[30] Foreign Application Priority Data

Jun. 3, 1989 [DE] Fed. Rep. of Germany ..... 3918228

[51] Int. Cl.[5] ..... B22D 11/10

[52] U.S. Cl. ..... 164/437; 164/337; 222/607

[58] Field of Search ..... 164/437, 439, 337, 488; 222/606, 607

[56] References Cited

U.S. PATENT DOCUMENTS

| | | | |
|---|---|---|---|
| 3,587,719 | 6/1971 | Schrewe | 164/437 |
| 3,888,294 | 6/1975 | Fastner | 164/437 |
| 3,935,895 | 2/1976 | Fastner | 164/437 |
| 4,423,833 | 1/1984 | Richter | 222/606 |
| 4,819,840 | 4/1989 | Lax | 164/437 |
| 4,949,778 | 8/1990 | Saito | 164/488 |

FOREIGN PATENT DOCUMENTS

| | | | |
|---|---|---|---|
| 61-23558 | 2/1986 | Japan | 164/437 |
| 61-180656 | 8/1986 | Japan | 164/437 |
| 63-60055 | 3/1988 | Japan | 164/437 |
| 63-235049 | 9/1988 | Japan | 164/437 |
| 1-192454 | 8/1989 | Japan | 164/437 |
| 235813 | 5/1945 | Switzerland | 164/437 |
| 422531 | 9/1974 | U.S.S.R. | 164/437 |

*Primary Examiner*—Richard K. Seidel
*Assistant Examiner*—Rex E. Pelto
*Attorney, Agent, or Firm*—Anderson Kill OlicK & Oshinsky

[57] ABSTRACT

A pouring tube for feeding molten steel into the pouring zone of a continuous casting mold includes a tube portion connected to a pouring container and an end portion provided with a bottom piece. To ensure safe operation of the pouring tube and an improved flow distribution, the bottom piece has in the direction of outlet openings thereof a width which is smaller, between 30% and 80%, than the distance between the walls which form the upper limits of the outlet openings.

6 Claims, 2 Drawing Sheets

POURING TUBE FOR FEEDING MOLTEN STEEL INTO A CONTINUOUS CASTING MOLD

This is a continuation of application Ser. No. 07/529,116 filed May 25, 1990 now abandoned.

BACKGROUND OF THE INVENTION

1. Field of the Invention

The present invention relates to a pouring tube for feeding molten steel into the pouring zone of a mold consisting of broad side walls and narrow side walls, particularly for casting thin steel slabs. The pouring tube includes a tube portion connected to a pouring container and an end portion which is provided with outlet openings directed toward the narrow side walls and a bottom piece at the end face of the pouring tube.

2. Description of the Related Art

In a pouring tube known from DE-A 37 09 188, to the cylindrical tube portion is connected a flattened end portion having slot-like outlet openings and a bottom piece with a raised inner contour. The extension of the bottom piece in the direction of the outlet openings is greater than the distance between the walls which form the upper limit of the outlet openings.

Although the known pouring tube is of complicated and expensive construction, it is not capable of providing the necessary operating safety and service life because of the high demands made during continuous steel casting. The molten steel emerges from the narrow outlet openings in concentrated form with a kinetic energy which is too high. As a result, particularly in a thin steel slab casting mold, washings may occur at the strand shell which is still thin and a surge wave may occur in front of the narrow side walls. Moreover, the uneven flow distribution within the mold occurring when pouring with the known pouring tube results in the formation of an irregular surface structure.

The present invention starts from the finding that the reason for the non-uniform, unstable molten steel distribution within the mold is the uneven speed with which the molten steel is discharged over the cross-sectional areas of the outlet openings.

Since the discharge speed is the greatest at the lower portion of the outlet slot, a strong vortex each is formed underneath the outlet openings and corresponding upwardly directed compensating flows occur in front of the short side walls which lead to a surge wave on the bath surface.

SUMMARY OF THE INVENTION

It is the object of the present invention to provide a pouring tube for pouring molten steel into a mold, particularly for casting thin steel slabs, which is simple to manufacture, robust and safe to operate. Also, by providing a better flow distribution, a surge wave on the bath surface and washings in the formed strand shell by the liquid steel are to be substantially reduced or avoided and a cast strand, particularly steel strip, with excellent structure and uniformly free from defects is to be obtained. Moreover, during the initial pouring procedure, splashing and adhering of molten steel to the mold walls are to be avoided.

In accordance with the present invention, the above object is met in a pouring tube of the above-described type by providing the bottom piece with a width in the direction of the outlet openings which is smaller than the distance between the walls forming the upper limits of the outlet openings.

As a result, the discharge speed in the region of the lower edge of the outlet openings and, thus, the widening of the molten metal stream resulting in washing of the strand shell are reduced. In addition, the vortices which are formed and the corresponding compensating flows are weaker, so that a better flow release is obtained and the surge waves are substantially reduced. The novel pouring tube is simple to manufacture and has a long service life.

In accordance with another feature of the invention, the bottom piece has in the direction of the outlet openings a width which is between 30% and 80% of the distance between the walls which define the upper limits of the outlet openings.

The inner surface of the bottom piece may be plane, raised or trough-shaped.

In accordance with another development of the invention, the side surfaces of the pouring tube may converge at an angle toward the bottom piece. Alternatively, the side surfaces may extend beyond the width of the bottom piece for guiding the pouring streams.

Finally, the flow distribution can be further improved by reducing the width of the outlet openings in the direction of the bottom piece.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENT

Figure 1:
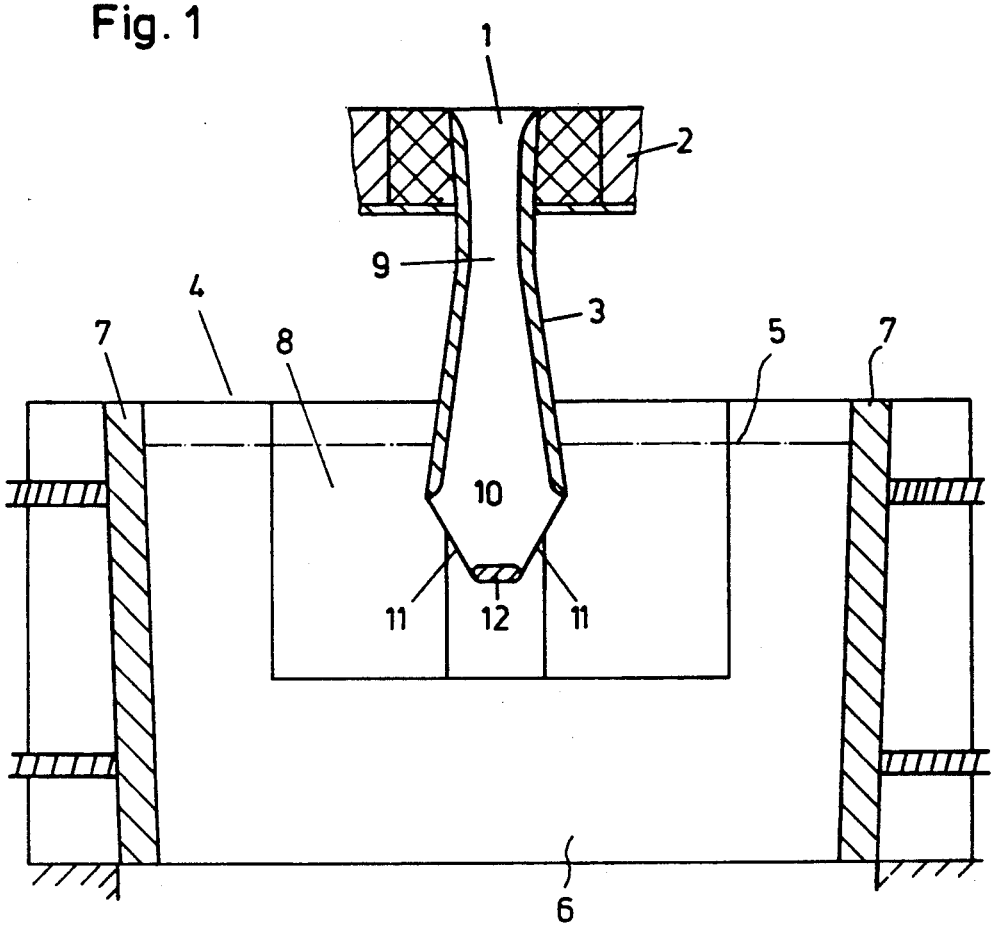
FIG. 1 is longitudinal sectional view of a continuous casting mold with a pouring tube extending into the pouring zone.
Figure 2:
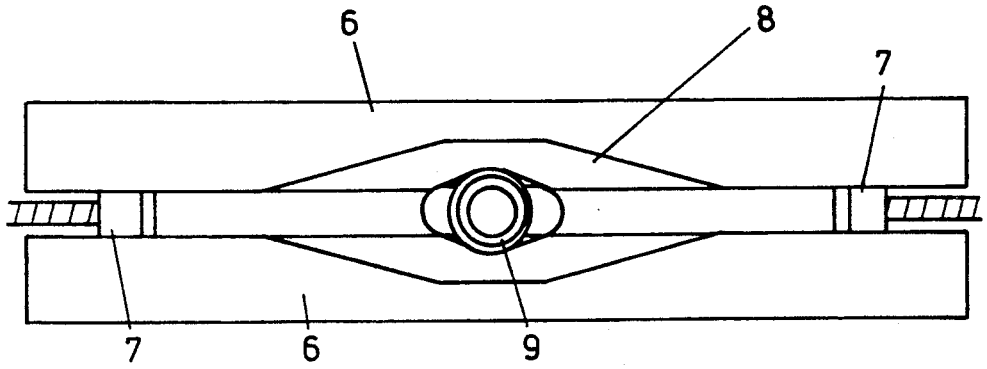
FIG. 2 is a top view of the continuous casting mold of FIG. 1.

As illustrated in FIG. 1 of the drawing, a pouring tube 3 is mounted at the bottom outlet 1 of a pouring container 2. The pouring tube 3 extends with its lower end into a steel strip casting mold 4 and under the pouring level 5. The steel strip casting mold 4 has two cooled broad side walls 6 and two narrow side walls 7 which are adjustably arranged between the broad side walls 6. As seen in FIGS. 1 and 2, the broad side walls 6 form a widened pouring zone 8 extending over a portion of the mold height for receiving the pouring tube 3.

The pouring tube 3 has an upper portion 9 with an approximately circular cross-section and a lower or end portion 10 having an oval shape. Outlet openings 11 are arranged in each of the narrow sides of the oval-shaped end of the tube 3. The outlet openings 11 are limited toward the bottom by a bottom piece 12 whose width a is smaller than the distance b between the walls located thereabove. The width a of the bottom piece advantageously is 30 to 80% of the distance b.

Figure 3:
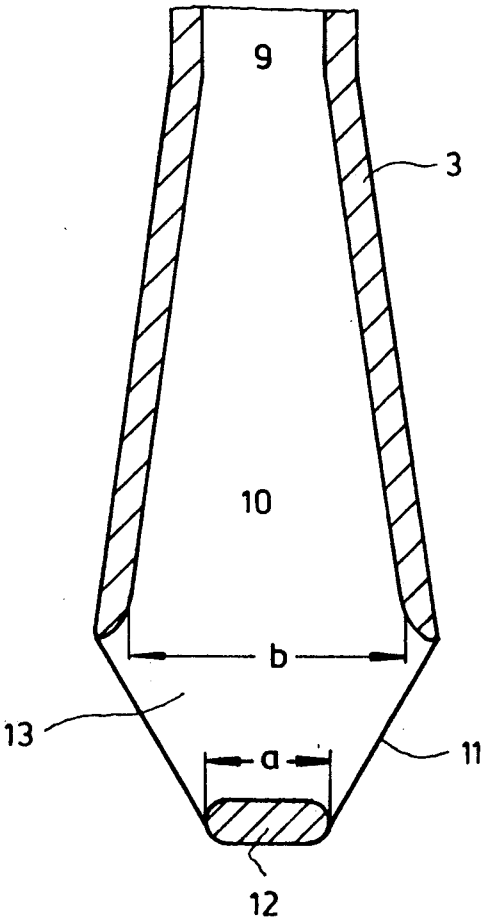
FIG. 3 is a sectional view of the pouring tube parallel to the outlet opening.

In the embodiment illustrated in FIG. 3, the wide pouring tube walls 13 which are of flat construction extend at an angle relative to the bottom piece 12.

Figure 5:
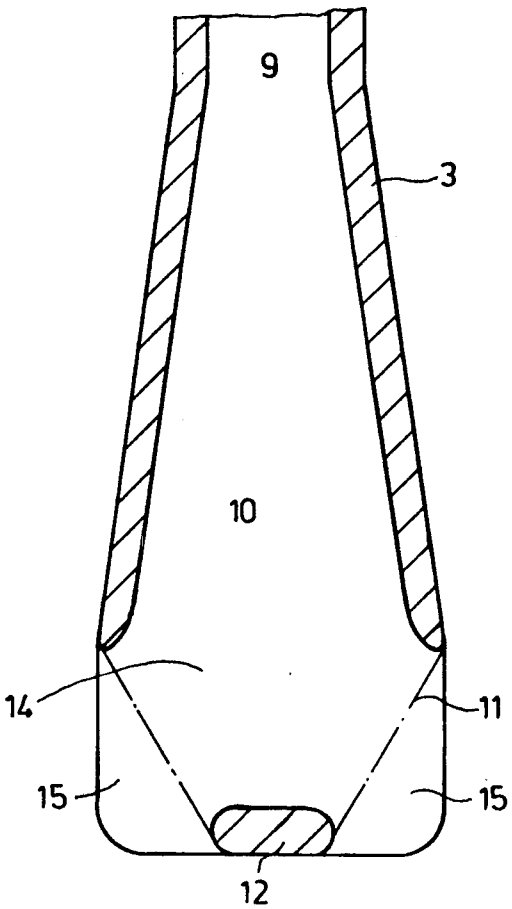
FIG. 5 is a sectional view of another pouring tube parallel to the outlet opening.

Alternatively, as shown in FIG. 5, the wide walls 14 of the pouring tube can extend at the full width to the end of the pouring tube, so that additional guiding surfaces 15 are formed in front of the outlet opening.

Figure 4:
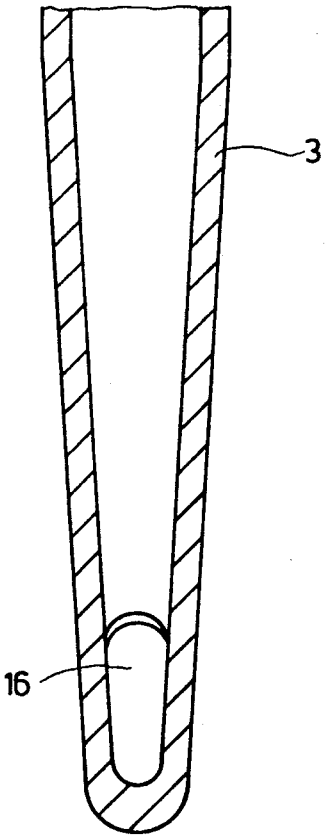
FIG. 4 is a sectional view of the pouring tube transversely of the outlet opening.

The outlet openings 11 are upwardly extending ovals 16. As can be seen in FIG. 4, the width of the outlet openings 11 may narrow toward the bottom.

The pouring tube according to the present invention may also be used for molds which have shapes different from those described above. Particularly, the mold may have a mold space which becomes continuously narrower toward the mold end.

While specific embodiments of the invention have been shown and described in detail to illustrate the application of the inventive principles, it will be understood that the invention may be embodied otherwise without departing from such principles.

We claim:

1. In a pouring tube for feeding molten steel into a pouring zone of a steel strip casting mold, the mold having broad side walls and narrow side walls connecting the broad side walls, the pouring tube having a side wall with an inner wall surface and including a first tube portion connected to a pouring container and a second end portion connected to the first portion, the end portion defining outlet openings directed toward the narrow side walls of the mold, each outlet opening having an upper end located in the side wall of the pouring tube and a lower end located in a bottom piece at the end of the pouring tube, the improvement comprising the bottom piece having a width between the lower ends of the outlet openings which is at most 80% of the distance between the inner wall surface of the side wall of the tube at the upper ends of the outlet openings, wherein the bottom piece is substantially flat and lipless adjacent the lower ends of the outlet openings.

2. The pouring tube according to claim 1, wherein the width of the bottom piece between the lower ends of the outlet openings is at least 30% of the distance between the wall portions of the tube at the upper ends of the outlet openings.

3. The pouring tube according to claim 1, wherein the bottom piece has an upper side, the upper side having a plane shape.

4. The pouring tube according to claim 1, wherein the second end portion of the tube has side walls extending between the outlet openings, the side walls extending at an angle relative to each other and narrowing toward the bottom piece.

5. The pouring tube according to claim 1, wherein the second end portion of the tube has side walls extending beyond the width of the bottom piece.

6. The pouring tube according to claim 1, wherein the outlet openings have a width which narrows from the upper ends toward the lower end thereof.

* * * * *